US012448085B2

(12) United States Patent
Giottoli

(10) Patent No.: US 12,448,085 B2
(45) Date of Patent: Oct. 21, 2025

(54) BOAT WITH MOVABLE STERN PLATFORM AND MADE OF TWO PARTS

(71) Applicant: FERRETTI S.P.A., Cattolica (IT)

(72) Inventor: Massimo Giottoli, Forlì (IT)

(73) Assignee: FERRETTI S.P.A., Cattolica (IT)

( * ) Notice: Subject to any disclaimer, the term of this patent is extended or adjusted under 35 U.S.C. 154(b) by 0 days.

(21) Appl. No.: 18/666,961

(22) Filed: May 17, 2024

(65) Prior Publication Data

US 2024/0417038 A1 Dec. 19, 2024

(30) Foreign Application Priority Data

Jun. 14, 2023 (IT) ..... 102023000012189

(51) Int. Cl.

| | |
|---|---|
| ***B63B 27/16*** | (2006.01) |
| ***B63B 23/40*** | (2006.01) |
| ***B63B 27/36*** | (2006.01) |
| *B63B 29/02* | (2006.01) |

(52) U.S. Cl.

CPC ..... *B63B 27/16* (2013.01); *B63B 23/40* (2013.01); *B63B 27/36* (2013.01); *B63B 2029/022* (2013.01)

(58) Field of Classification Search

CPC ... B63B 2029/022; B63B 23/00; B63B 27/14; B63B 27/16; B63B 35/40; B63B 2027/165; B63B 2003/485; B60P 1/4414; B60P 1/445; B60P 1/44; B60P 1/4485

USPC ..... 280/163, 164.1; 414/917, 921, 556, 557, 414/558, 592; 296/62; 114/259, 373, 114/352, 371

See application file for complete search history.

(56) References Cited

U.S. PATENT DOCUMENTS 4,124,097 A * 11/1978 Hawks ..... B60P 1/4421 280/166
4,180,366 A * 12/1979 Roth ..... A61G 3/068 280/166
5,425,615 A * 6/1995 Hall ..... A61G 3/068 280/166
5,664,516 A * 9/1997 Breeden ..... B63B 23/32 114/259
6,327,992 B1 12/2001 Martin (Continued)

FOREIGN PATENT DOCUMENTS

CN 210047591 U 2/2020
DE 202009007140 U1 * 10/2009 ..... B63B 23/32

(Continued)

OTHER PUBLICATIONS

Zolov Vladislav: "Fairline will present the Targa 45 GT with garage for the Boot Dusseldorf—2020 tender", itBoat, Nov. 27, 2019, XP093123690, Retrieved from the Internet: URL:<https://itboat.com/news/5511-fairline-will-present-the-targa-45-gtwith-garage-for-the-boot-dsseldorf-2020-tender>, [retrieved on Jan. 25, 2024].

(Continued)

*Primary Examiner* — Gregory W Adams

(74) *Attorney, Agent, or Firm* — Vorys, Sater, Seymour and Pease LLP

(57) ABSTRACT

A boat includes a hull having a movable stern platform which can be lowered into the water so as to allow to drop or retrieve a small vessel associated with the boat into/from such water. The stern platform includes two movable parts differently from each other.

16 Claims, 8 Drawing Sheets

(56) References Cited

U.S. PATENT DOCUMENTS

| | | | | |
|---|---|---|---|---|
| 7,121,226 | B2 * | 10/2006 | Grimaldi | B63B 27/14 182/84 |
| 7,735,441 | B2 | 6/2010 | Borum et al. | |
| 8,833,290 | B2 * | 9/2014 | Mueller | B63B 27/30 114/343 |
| 9,032,895 | B2 | 5/2015 | Buck | |
| 9,340,262 | B1 * | 5/2016 | Boyd | B63B 27/143 |
| 9,592,887 | B2 * | 3/2017 | Frabetti | B63B 27/143 |
| 10,351,215 | B2 * | 7/2019 | Scozzoli | B63B 27/30 |
| 10,526,053 | B2 * | 1/2020 | Inzadi | B63B 27/16 |
| 11,254,394 | B2 * | 2/2022 | König | B63B 27/143 |
| 2009/0056611 | A1 * | 3/2009 | Hirayama | B63B 27/36 114/259 |
| 2010/0124479 | A1 * | 5/2010 | Brooks | B60P 1/4471 414/557 |
| 2011/0023770 | A1 * | 2/2011 | Brown | B63B 27/143 114/362 |
| 2016/0083050 | A1 | 3/2016 | Frabetti | |
| 2021/0047005 | A1 * | 2/2021 | Fafard | B63B 27/146 |

FOREIGN PATENT DOCUMENTS

| | | | |
|---|---|---|---|
| DE | 102009013626 | A1 | 9/2010 |
| WO | 2014199314 | A2 | 12/2014 |
| WO | 2016207963 | A1 | 12/2016 |

OTHER PUBLICATIONS

Rapporto di Ricerca (translates as Research Report), Jan. 25, 2024, for Italian patent application No. 102023000012189, filed Jun. 14, 2023.

* cited by examiner

BOAT WITH MOVABLE STERN PLATFORM AND MADE OF TWO PARTS

CROSS-REFERENCE TO RELATED APPLICATION

This claims the benefit of Italian patent application no. 102023000012189, filed Jun. 14, 2023, incorporated by reference.

FIELD OF THE INVENTION

Forming an object of the present invention is a boat comprising a hull provided with movable stern platforms, according to the preamble of the main claim.

BACKGROUND OF THE INVENTION

Boats of the type mentioned above having a movable stern platform have long been known. Usually, such platform is present at a stern compartment used for containing a small vessel or tender and which can be closed by a hold door thereof. Besides acting as a "small sundeck" for the passengers of the boat, the stern platform is preferably movable so as to allow the launching/hauling of a small vessel or tender, as well as allow, through a special roller unit, a quick and easy introduction of the tender into the water (or the retrieving thereof from the latter) from the stern compartment.

Boats of this type are for example disclosed by WO2016/207693 and US 2016/0083050 on behalf of the Applicant in question.

There are also known various methods for moving the stern platform: besides those described in the prior art documents mentioned above, pantograph systems which translate the platform into the water and retrieve it therefrom, maintaining such platform in horizontal position so as to allow it to support the tender during the movement thereof, are generally used. Examples of such solutions are described in U.S. Pat. Nos. 9,032,895, 6,327,992, 7,735,441, WO2014/199314 and DE102009013626.

Despite allowing to maintain the movable platform in a necessarily horizontal position during the movement of the tender, such systems reveal various drawbacks: first and foremost, their movable platforms have large surface dimensions, and this creates high resistance when lifting and retrieving the platform (which is at least partially submerged by the water when dropped thereinto) from the water. The large dimensions mentioned above also entail a high weight of the platform with resulting transfer of stresses onto the stern of the boat.

Lastly, the movable platforms should not interfere with the mechanical members of the boat (such as surface propellers, flaps, steering propellers, etcetera) underlying the platform; this often hinders the use of pantograph systems which would interfere with said mechanical members.

SUMMARY OF THE INVENTION

An object of the present invention is to provide a boat which overcomes the drawbacks of prior art solutions.

In particular, an object or the invention is to provide a boat where the movable platform has a large walkable surface when retrieved from the water, but having only a portion of the entire movable surface thereof, the one required for launching or retrieving the tender, adapted to be submerged into the water.

Another object of the present invention is to provide a boat of the type mentioned above where the movable platform cannot interfere with the mechanical elements associated with the hull and underlying such movable platform.

These and other objects which shall be more apparent to the person skilled in the art are attained by a boat according to the attached claims.

BRIEF DESCRIPTION OF THE DRAWINGS

For a better understanding of the present invention, the following drawings are attached hereto purely by way of non-limiting example, wherein.

DETAILED DESCRIPTION OF EMBODIMENTS OF THE INVENTION

Figure 1:
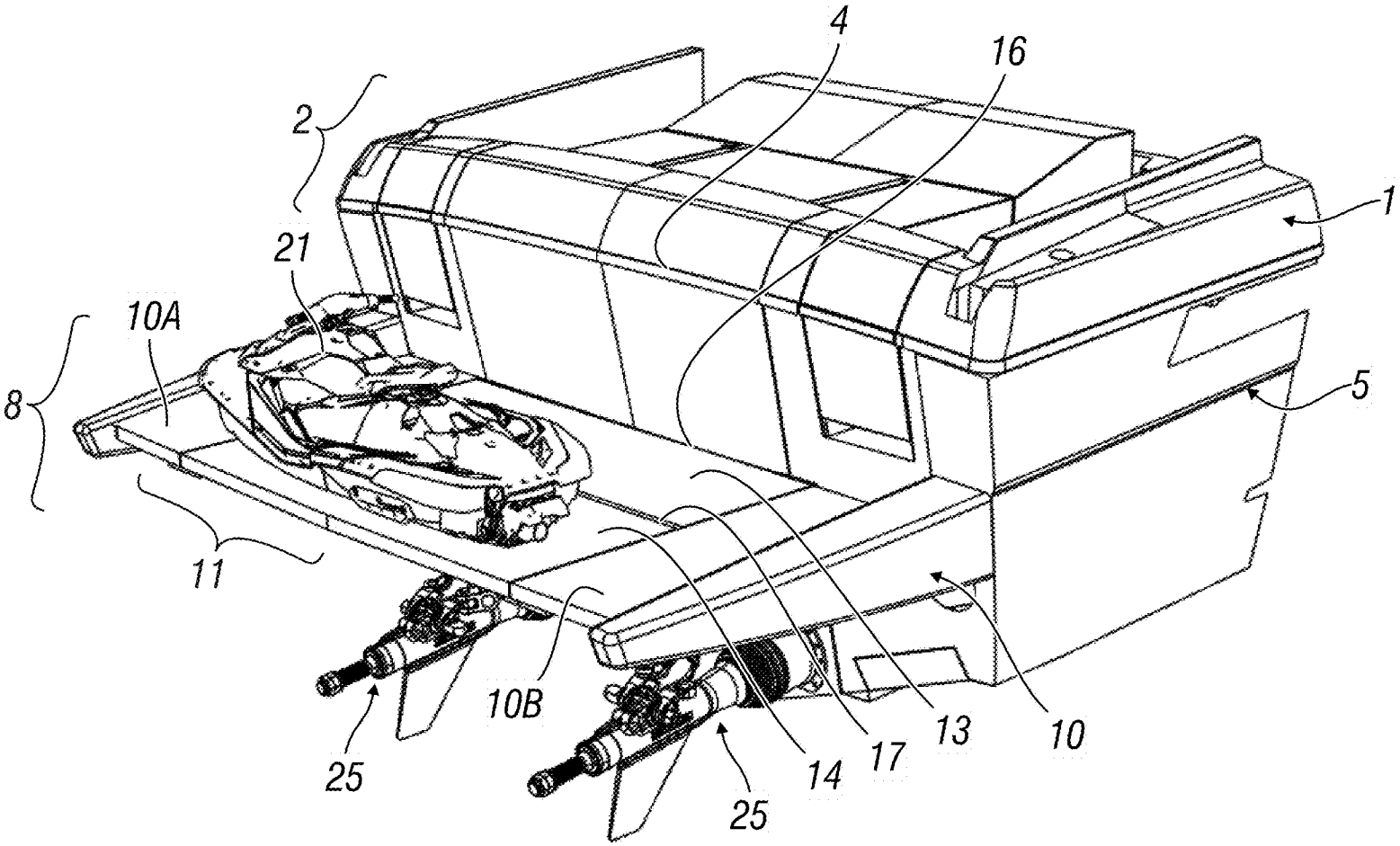
FIG. 1 shows a perspective view of the stern of a boat (the latter only shown partially) provided with a stern platform, on the latter there being arranged a personal watercraft by way of example.

With reference to the aforementioned figures, it shows (only partially) a boat 1 having a transom (or more simply a "stern") 2. The latter comprises a stern compartment (internal) 3 (see FIGS. 6-8) provided with a hold door 4 thereof moved in a per se known manner (and not shown).

At the stern 2, the boat 1 (having a hull 5) has a platform 8. The platform has extensive dimensions when retrieved from the water.

Such platform comprises a fixed part 10 and a movable part 11. The fixed part 10 (or "fixed platform") provides for two portions 10A and 10B integrally joined with the hull 5 of the boat 1 positioned on the sides of the movable part 11 (or "movable platform") and laterally delimiting the latter. The movable platform, in particular, is arranged frontally that is at the stern compartment 3.

The movable platform 11 has a flat walkable surface when retrieved from the water and it comprises two mutually interconnected parts or portions 13 and 14, both having the possibility of movement with respect to the fixed platform 10. In particular, a first portion 13 of the movable platform 11 rotates with respect to the hull 5 given that it is hinged to the hull 5 at a first end 16 thereof, while the second portion 14 of such platform 11 is hinged to a second end 17 of the first portion 13 through a first end 20 thereof.

When the movable platform 11 is retrieved from the water, the portions 13 and 14 lie on the same plane P and define the walkable surface: in such position of the movable platform 11, both portions 13 and 14 are walkable, they are adjacent and arranged consecutively to each other (that is arranged adjacent to each other, one after the other) on said plane P.

Both portions 13 and 14 of the movable platform can be "lowered" simultaneously towards the water on which the boat 1 lies, but only the portion 14 can be completely submerged into the water through a translation thereof during which the portion 14 remains in horizontal position. This due to the fact that such second platform portion 14 is hinged to the first platform portion 13 and also due to the conformation of an articulated parallelogram actuation mechanism which allows the movement of the platform 11 and of the portions thereof. Such mechanism will be described hereinafter.

The movement mentioned above allows, for example, to introduce a personal watercraft 21 (shown in FIG. 1) into the water and/or to launch a tender 22, which can be stowed away into the stern compartment 3, through a roller unit 23 which will be described subsequently.

Figure 3:
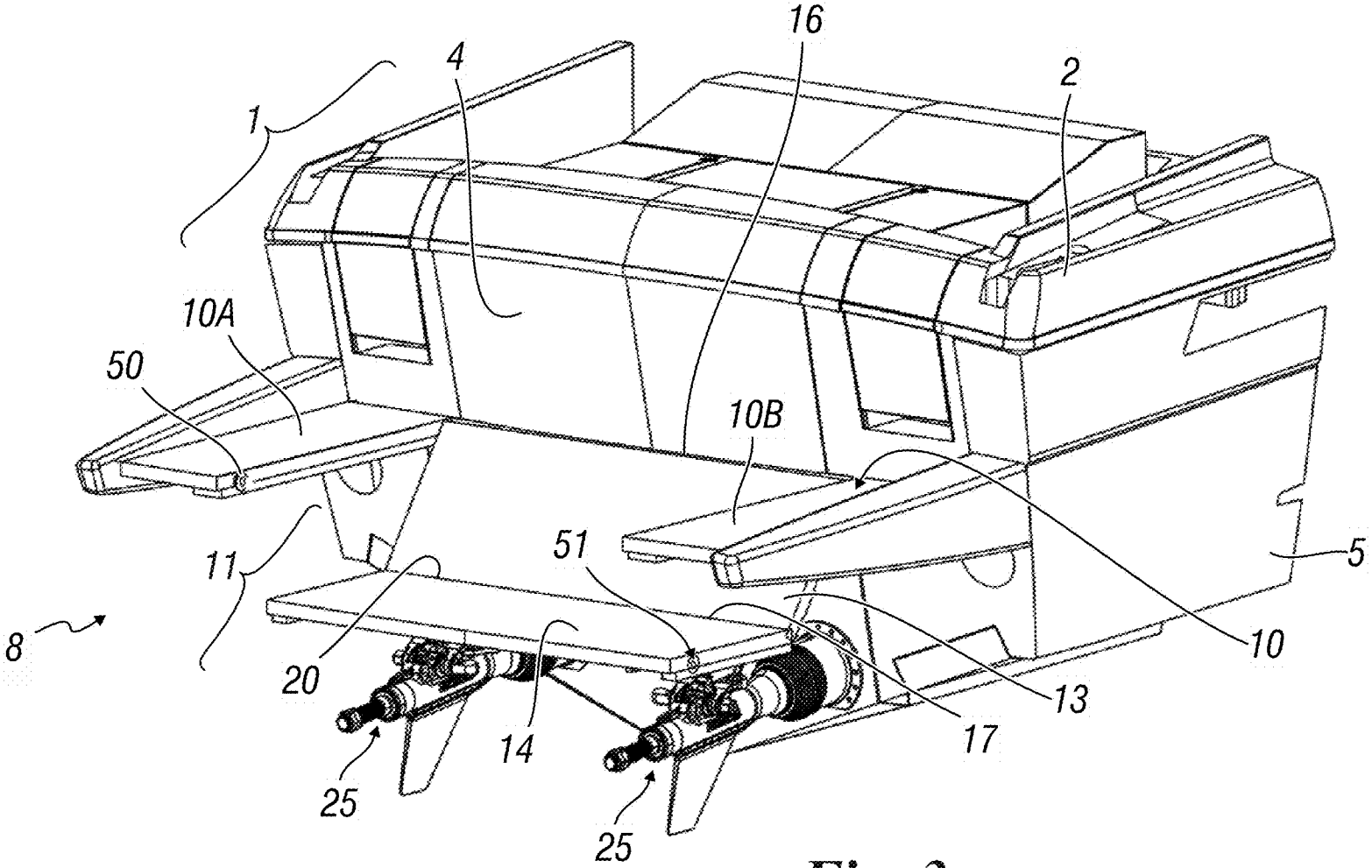
FIG. 3 shows a perspective view similar to that of FIG. 1 but with stern platform in an operative configuration.

The fact that only the second portion 14 of the movable platform 11 can be submerged into the water with a translatory movement, allows to prevent such movable platform from interfering with the elements underlying it, such as for example the common drive systems 25 of the boat 1 (shown in FIGS. 1 and 3 only). This solves an existing problem in the prior art platforms actuated by pantograph systems.

Furthermore, the fact that only the second portion 14 of the movable platform 11 is submerged, allows to reduce the stresses for the retrieval thereof from the water and especially the stresses acting on the stern 2 of the hull 5 when the platform portion is submerged with respect to the prior art solutions where the entire movable platform is submerged into the water.

Figure 5:
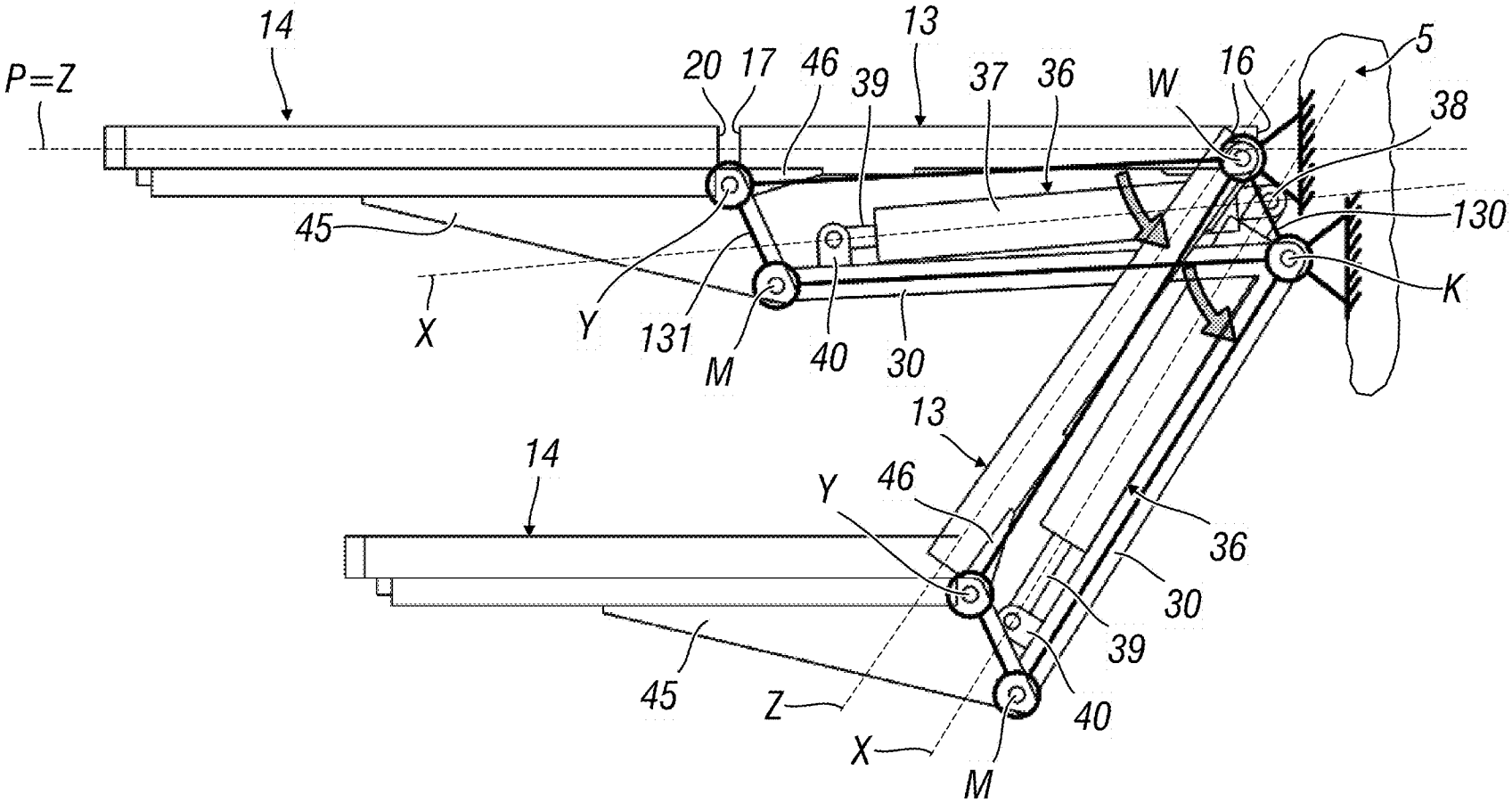
FIG. 5 shows a schematic view of a system for moving the stern platform of the boat of FIG. 1.

In order to move the movable platform 11 and generate the rotation of the first portion 13 thereof with respect to the hull 5, as well as to simultaneously generate the translation of the second portion 14 thereof with respect to hull and the fixed platform 10 through a simultaneous relative rotation of the second portion with respect to the first portion, there is provided for an articulated parallelogram actuation mechanism shown schematically in FIG. 5.

Figure 2:
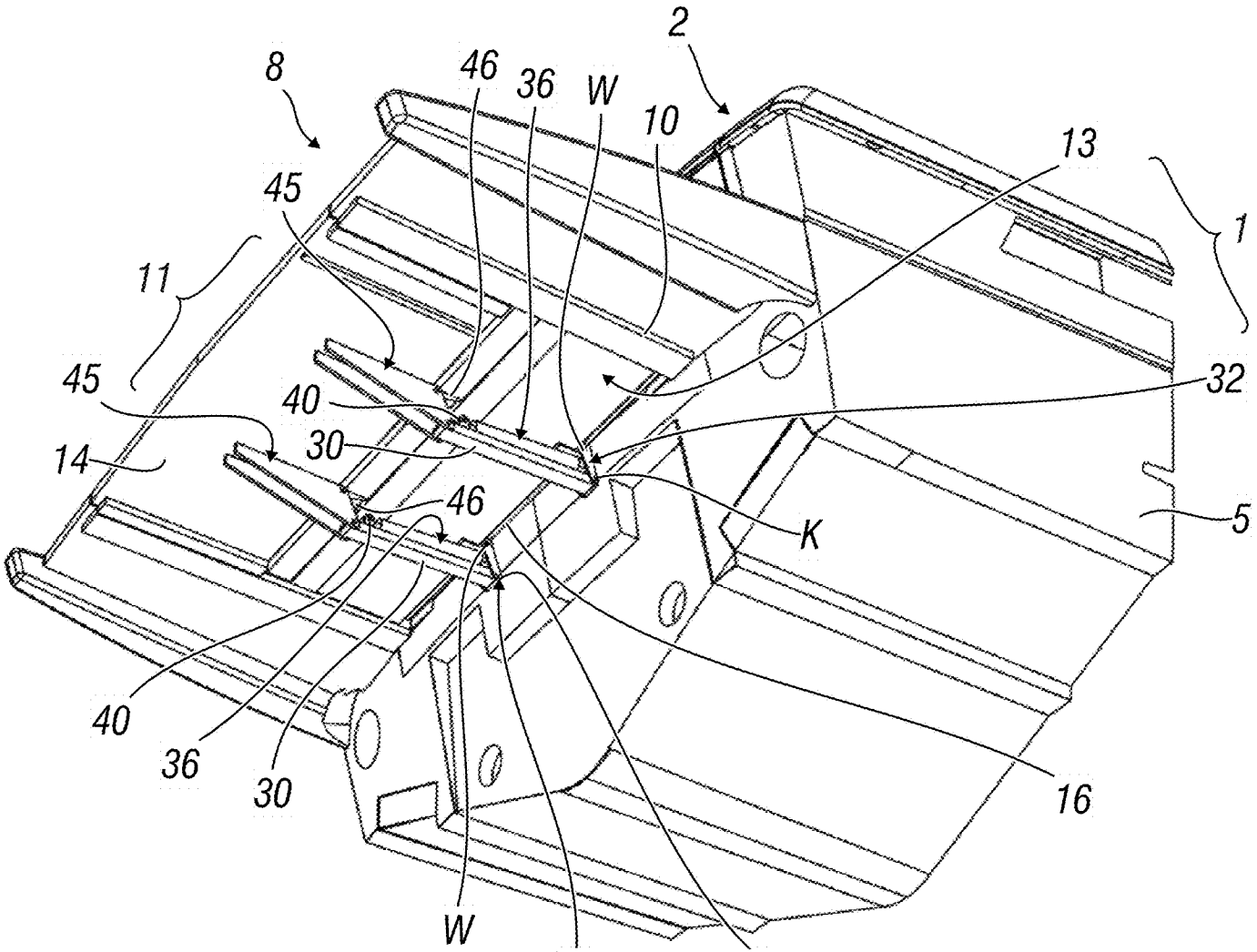
FIG. 2 shows a bottom perspective view of the stern of the boat of FIG. 1.
Figure 4:
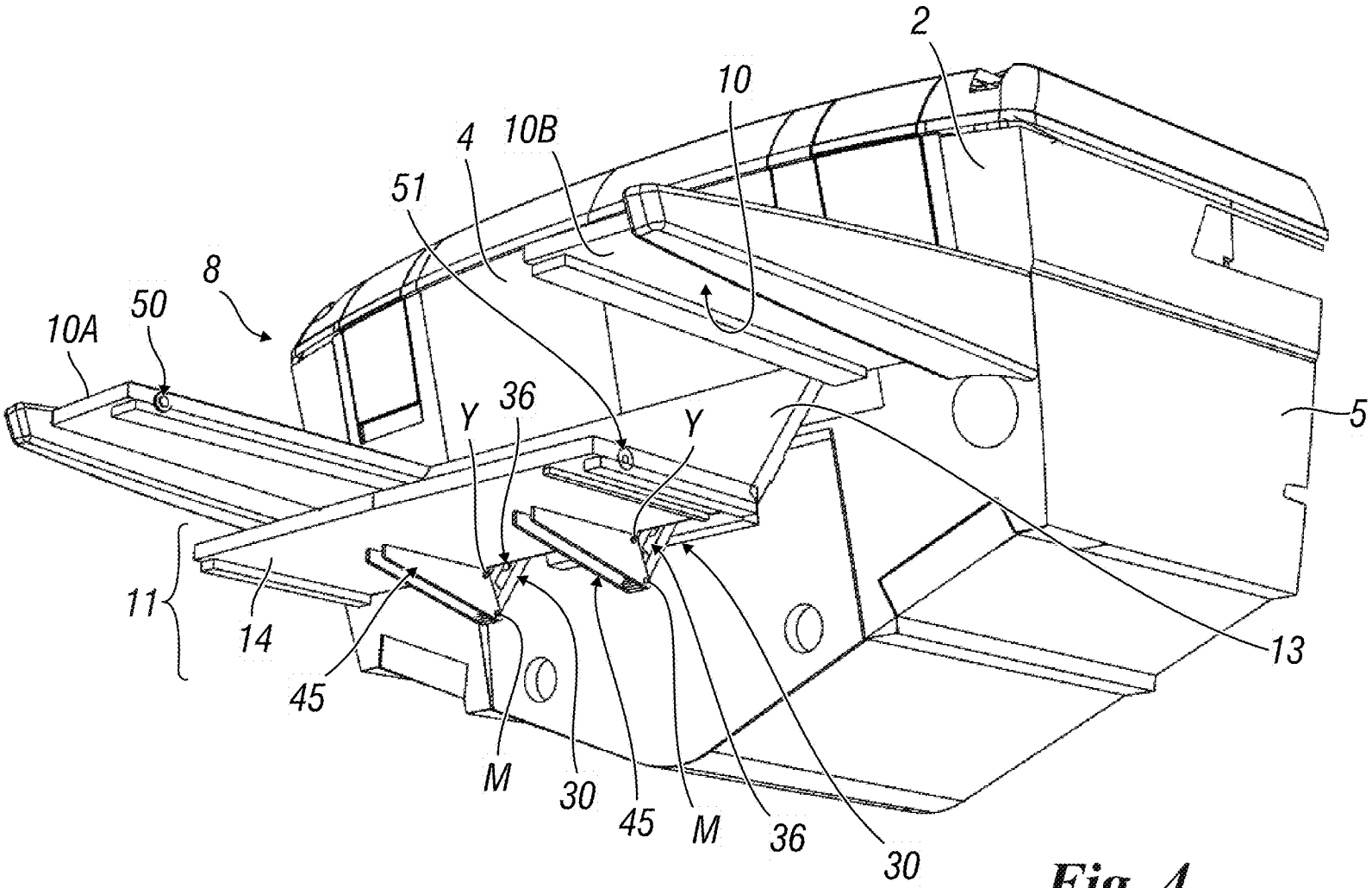
FIG. 4 shows a bottom perspective view of the stern of the boat of FIG. 3.

Such mechanism comprises a first pair of hinge axes or coaxial hinges W between the end 16 of the first portion 13 of the movable platform 11 and the hull 5. Beneath said first portion 13 there are associated two arms 30 underlying the first portion 13 of the movable platform 11 and hinged to the hull 5 each through a second pair of hinge axes or coaxial hinges K separated from the first coaxial hinges or hinge axes W. Each pair of coaxial hinges or hinge axes W and K is advantageously obtained in a corresponding support element 32 fixed to the hull 5 (see FIG. 2). The two support elements 32 support the first platform portion 13 when it is rotated with respect to the plane P on which also the fixed platform 10 lies (see FIGS. 3, 4 and 8). Each element 32 therefore contains the axes (W, K) around which the platform portion 13 and/or the arm 30 rotate. In addition, each element 32 may contain a support which sustains such portion and/or the arm mentioned above and, generally such support can be obtained in any manner (or even not provided for).

It should be observed that the movable platform 11 or a first part thereof 13 is hinged to the hull 5 through the support elements 32. Therefore, to the purposes of the invention the first part 13 is hinged to the hull 5 given that the elements 32 are fixed thereto and therefore rotates with respect to the with respect to the hull 5 rotating with respect to said support elements 32.

In the embodiment of the figures, between each arm 30 and the platform portion 13 there is a hydraulic actuator 36 (or pneumatic or electrical actuator) having a longitudinal axis X inclined with respect to the plane P and to a plane Z on which the first and the second platform portion 13, 14 lie (see FIGS. 1 and 2) which perfectly fits with the plane P (navigation position) when the movable platform is not submerged into the water or it is not moved with respect to the fixed platform 10, for example as shown in FIG. 1.

The actuator 36 has a cylinder 37 hinged—in 38—directly to the respective support element 32 (fixed to the hull 5) and a plunger 39 hinged to a bracket 40 integrally joined with the arm 30 corresponding (or alternative to the platform portion 13). Obviously, there can also be provided for the dual solution which is therefore comprised in the present description.

Therefore, each arm 30 is hinged—through a hinging axis M—to a body 45 fixed beneath the second platform portion 14 in any known manner.

Another hinging axis Y constrains such body 45 to a bracket 46 fixed beneath the first platform portion 13 in proximity of the end 17 of the latter. Such hinging axes Y define the hinging between the ends 17 and 20 respectively of the first and of the second platform portion 13 and 14.

With reference to FIG. 5, it should be observed that the segments 130 and 131 which join the axes W and K and the axes M and Y, respectively, are parallel to each other and equally long; should the end 20 be proximal to the end 17 (and to the bracket 46), with platform 11 not lowered, this is due to the vicinity between the axes W and K on the element 32.

It should be observed that a pair of common locking pawls 50 arranged on the portions 10A, 10B of the fixed platform towards the movable platform 11 cooperating with a corresponding abutment pair 51 associated with the movable platform keeps the latter locked on the plane P (navigation position).

The particular embodiment of the actuation mechanism shown in FIG. 5 and described above enables to obtain the movement of the movable platform 11 with the particular actuation of the portions thereof 13 and 14. This particularly allows to move the second portion so as to always keep it horizontal or on a plane parallel to the plane P. It allows the possibility of moving a tender, a personal watercraft or the like for the launch or retrieval thereof from the water and averting the risk of it capsizing or slipping into the water.

Figure 6:
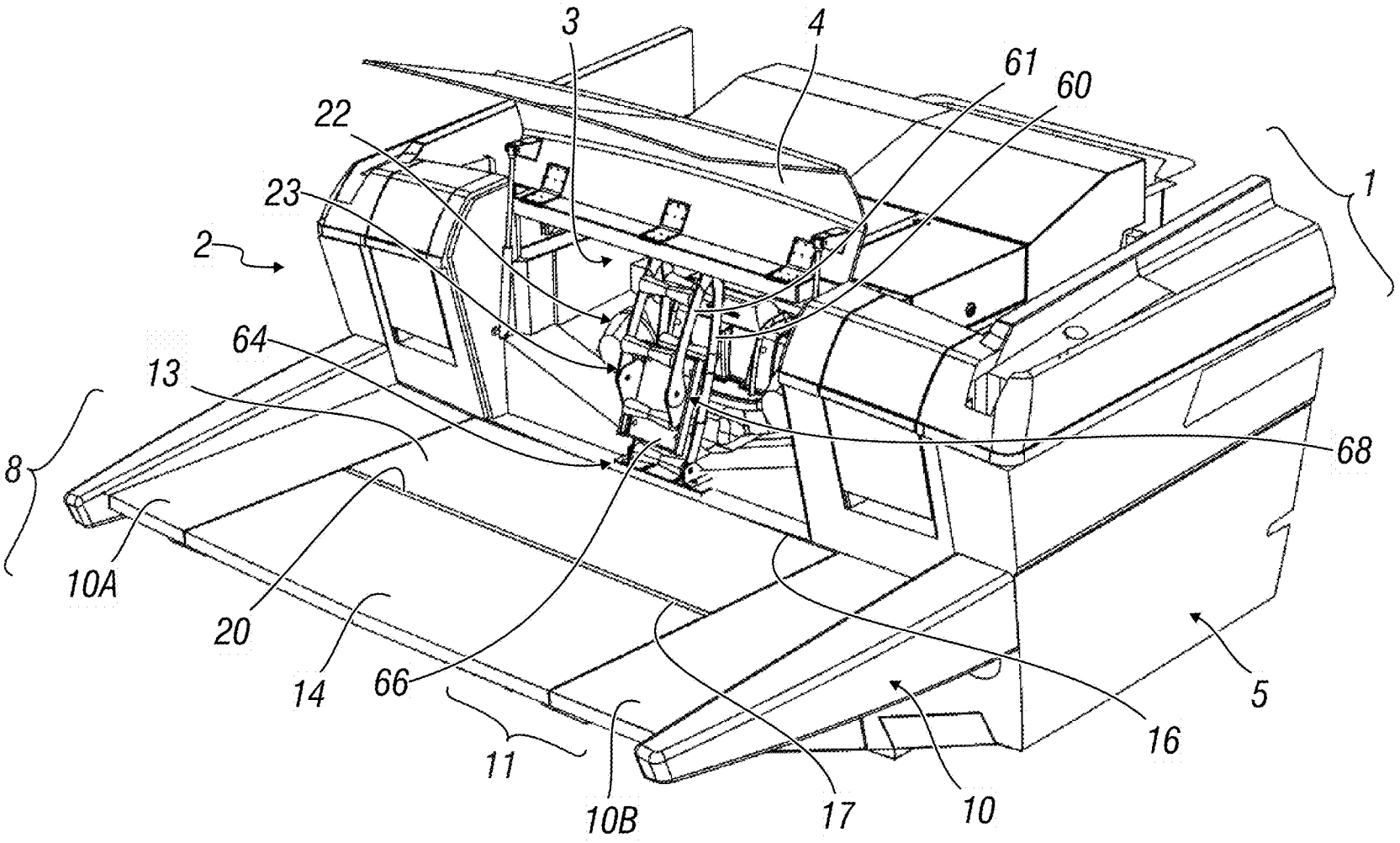
FIG. 6 shows a view similar to that of FIG. 1, but in which there is shown a stern compartment of the boat containing a tender and with relative hold door open.
Figure 7:
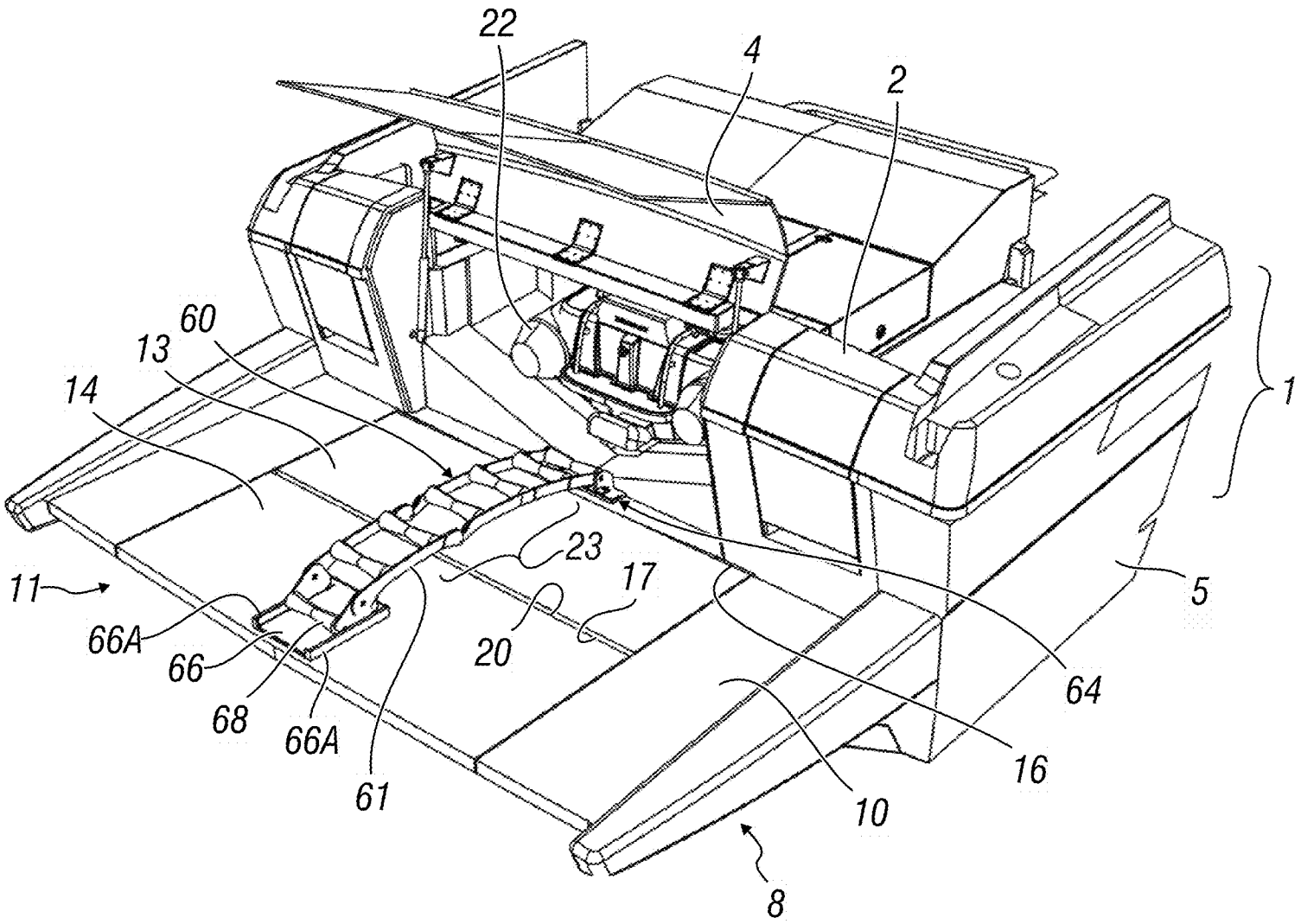
FIG. 7 shows a view similar to that of FIG. 6, but during a step for preparing the launching of a tender.
Figure 8:
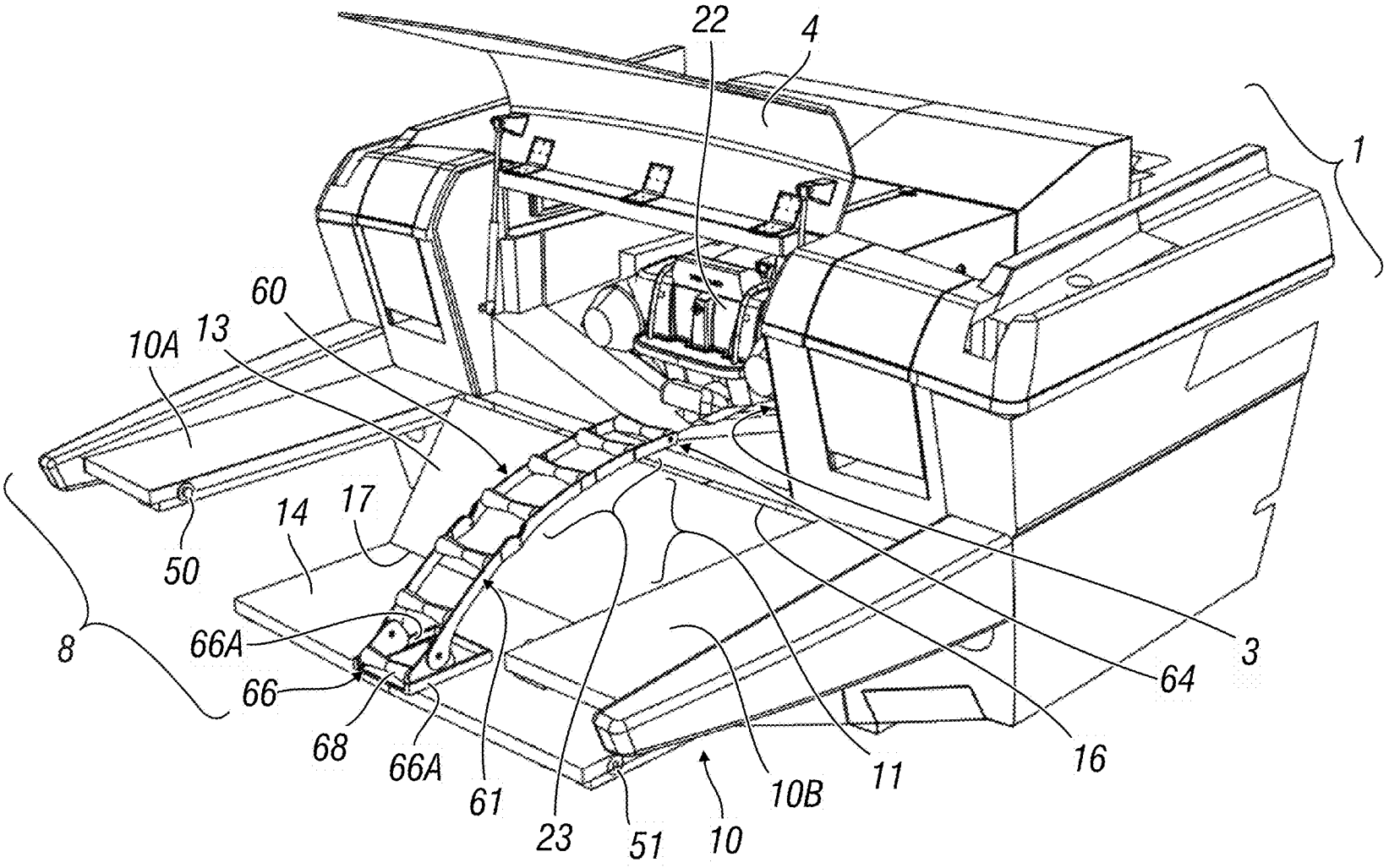
FIG. 8 shows a view similar to that of FIG. 6; but during a further step for preparing the launching of the tender.

FIGS. 6-8 show the boat 1 provided with a roller unit 23 for the compartment of the tender 22. Such roller unit comprises a first bow part 60 and second stern part 61: the first bow part is fixed to an element 64, fixed or integrally joined with the hull 5 while the second roller unit part 61 (hinged to the first 60) is adapted to be constrained—through an end plate 66—to the second platform portion 14 of the movable platform 11. Such end plate 66 is constrained to the stern part 61 of the roller unit. Such part being suitable to slide in a per se known manner along edges 66A of such plate 66.

The bow part 60 is hinged to the fixed element 64 of the roller unit integrally joined with the hull. The stern part 61 is installed on the end plate 66: such plate is fixed—in a known manner—to the platform portion 14 when the roller unit is to be used. The end plate 66 has the edges 66A which contain, for example, linear guides (not shown) in which carriages (also not shown) move integrally joined with the roller unit part 68 and constrained to the stern part 61 and which can slide on said guides.

The fact that the parts 60 and 61 of the roller unit are hinged to each other allows to reduce the overall dimensions of the roller unit when it is stowed away in the compartment 3. Once the roller unit 23 is positioned on the platform, the roller unit parts 60 and 61 are locked to each other using an appropriate system (for example with a deadbolt) not shown in the figures.

The launching of the tender provides for the deployment of the roller unit 23, the fixing (removable) of the end plate 66 to the second portion 14 of the movable platform 11 and therefore the lowering of such movable platform towards the water (FIG. 8).

At this point, the tender 22 may be made to slide along the roller unit and it can be launched.

It should be observed that the roller unit can be easily deployed from the position of FIG. 6 to the position of FIG. 8 in a relatively simple manner thanks to the hinging between the first bow part 60 and the second stern part 61.

The invention allows an excellent use of the movable platform, it is relatively easy to obtain and the activation thereof cannot jeopardise the wholeness of mechanical or structural members of the boat arranged beneath the stern platform.

A preferred embodiment of the invention has been described. However, many other variants may be provided in the light of the description above and they fall within the scope of protection of the invention defined by the claims that follow.

The invention claimed is:

1. A boat comprising a hull having a transom having a stern platform, such stern platform comprising a first part or fixed platform and a second part or movable platform, there being provided for actuator means adapted to move the movable platform from a navigation position towards the water in which the boat is found or to lift such movable platform from the water to return the movable platform to such navigation position in which it is removed from the water, wherein the movable platform comprises a first portion and a second portion, the first portion having a planar surface and the second portion having a planar surface, both such portions being walkable when the movable platform is in the navigation position and the movable platform is lifted from the water, said portions lying on a common plane when the platform is in said position so that both can be walkable, wherein there is provided for at least one element for supporting the first portion of the movable platform fixed to the hull of the boat, said movable platform rotating with respect to said at least one support element, both said portions being movable with respect to the hull of the boat and being mutually interconnected, the first portion being adapted to rotate with respect to the hull and the second portion being adapted to translate with respect to the such hull remaining on a horizontal plane, the first portion having opposed first end and second end and the first portion being hinged to the hull at the first end and the second portion being hinged to the second end of the first portion, said actuator means being an articulated parallelogram mechanism adapted to carry out the movements of the platform portions mentioned above.

2. The boat according to claim 1, wherein the first portion of the movable platform is hinged to the second portion of the movable platform.

3. The boat according to claim 1, wherein the first portion of the movable platform rotates with respect to the hull simultaneously with the translation of the second portion of the movable platform.

4. The boat according to claim 1, wherein the fixed platform has a first portion fixed platform and a second portion fixed platform integrally joined with the hull of the boat positioned on the sides of the movable platform and laterally delimiting the moveable platform and the first portion planar surface is from the first portion fixed platform to the second portion fixed platform, and the second portion planar surface is from the first portion fixed platform to the second portion fixed platform.

5. The boat according to claim 4, wherein the first portion of the movable platform is associated with at least one arm of the articulated parallelogram mechanism underlying the first portion mentioned above, said first portion of the movable platform and said arm being separately hinged to said support element.

6. The boat according to claim 1, wherein the articulated parallelogram actuator means comprise an actuator member hinged at one end to said at least one support element and hinged at the other end to a body alternatively fixed to said arm or to the first platform portion.

7. The boat according to claim 5, wherein said arm is hinged to a body fixed beneath the second movable platform portion, such body being hinged to the first portion of the movable platform, the distance between said hinges of the body fixed beneath the second platform portion and hinged to the first platform portion being equal to the distance between the hinges which constrain the first movable platform portion to the relative support element and the underlying arm to such first movable platform portion.

8. The boat according to claim 6, wherein said actuator means comprise an actuator of the hydraulic, pneumatic, or hydro-pneumatic type comprising at least one cylinder having the end hinged to the support element and a plunger hinged to a body alternatively integrally joined with said arm or with said first platform portion.

9. The boat according to claim 6, wherein said actuator means comprise an electric actuator.

10. The boat according to claim 7, wherein the body associated with the second movable platform portion is hinged to a bracket fixed to the first movable platform portion in proximity of an end of such second movable platform portion, such hinging defining the hinging between said first and second movable platform portion.

11. The boat according to claim 1, comprising a stern compartment provided with a closing hold door thereof and in whose proximity there is the first portion of the movable platform.

12. The boat according to claim 10, wherein there is provided for a roller unit which can be removed from said stern compartment and which can be constrained to the second portion of the movable platform.

13. A boat comprising a hull having a transom having a stern platform, such stern platform comprising a first part or fixed platform and a second part or movable platform, there being provided for actuator means adapted to move the movable platform from a navigation position towards the water in which the boat is found or to lift such movable platform from the water to return the movable platform to such navigation position in which it is removed from the water, wherein the movable platform comprises a first portion and a second portion, both such portions being walkable when the movable platform is in the navigation position and the movable platform is lifted from the water, said portions lying on a common plane when the platform is in said position so that both can be walkable, both said portions being movable with respect to the hull of the boat and being mutually interconnected, the first portion being adapted to rotate with respect to the hull and the second portion being adapted to translate with respect to the such hull remaining on a horizontal plane, said actuator means being an articulated parallelogram mechanism adapted to carry out the movements of the platform portions mentioned above, wherein there is provided for at least one element for supporting the first portion of the movable platform fixed to the hull of the boat, said movable platform rotating with respect to said at least one support element, and wherein said arm is hinged to a body fixed beneath the second movable platform portion, such body being hinged to the first portion of the movable platform, the distance between said hinges of the body fixed beneath the second platform portion and hinged to the first platform portion being equal to the distance between the hinges which constrain the first movable platform portion to the relative support element and the underlying arm to such first movable platform portion.

14. The boat according to claim 13, wherein the first portion of the movable platform is associated with at least one arm of the articulated parallelogram mechanism underlying the first portion mentioned above, said first portion of the movable platform and said arm being separately hinged to said support element.

15. The boat according to claim 13, wherein the body associated with the second movable platform portion is hinged to a bracket fixed to the first movable platform portion in proximity of an end of such second movable platform portion, such hinging defining the hinging between said first and second movable platform portion.

16. The boat according to claim 15, wherein there is provided for a roller unit which can be removed from said stern compartment and which can be constrained to the second portion of the movable platform.

* * * * *